US009140443B1

(12) United States Patent
Galvez

(10) Patent No.: US 9,140,443 B1
(45) Date of Patent: Sep. 22, 2015

(54) ILLUMINATED CUP HOLDER

(71) Applicant: Oscar Galvez, La Habra, CA (US)

(72) Inventor: Oscar Galvez, La Habra, CA (US)

( * ) Notice: Subject to any disclaimer, the term of this patent is extended or adjusted under 35 U.S.C. 154(b) by 0 days.

(21) Appl. No.: 14/057,990

(22) Filed: Oct. 18, 2013

Related U.S. Application Data

(60) Provisional application No. 61/715,663, filed on Oct. 18, 2012.

(51) Int. Cl.
*F21V 33/00* (2006.01)

(52) U.S. Cl.
CPC ..... *F21V 33/0036* (2013.01)

(58) Field of Classification Search
CPC ..... B36B 45/04; B36B 29/06; F21V 33/003
USPC ..... 362/101, 154; 114/343; 248/311.2
See application file for complete search history.

(56) References Cited

U.S. PATENT DOCUMENTS

| | | | | |
|---|---|---|---|---|
| 6,092,905 | A * | 7/2000 | Koehn | 362/101 |
| 6,896,387 | B2 | 5/2005 | Renfro | |
| 7,500,443 | B1 * | 3/2009 | Allen | 114/343 |
| 8,353,604 | B2 | 1/2013 | Glazier | |
| 2003/0076672 | A1 | 4/2003 | Head | |
| 2012/0002400 | A1 * | 1/2012 | Lindholm | 362/101 |
| 2012/0075842 | A1 | 3/2012 | Goto | |

* cited by examiner

*Primary Examiner* — Anh Mai
*Assistant Examiner* — Glenn Zimmerman
(74) *Attorney, Agent, or Firm* — Kenneth L. Green; Averill & Green

(57) ABSTRACT

An illuminated cup holder includes a power source in a base, light sources, a light conducting body, and a reflecting rim cover. The power source may be batteries or an AC adapter, or both. The light conducting body includes a rim, walls, and a bottom edge. The bottom edge is preferably rippled to provide a light pattern. The light sources are preferably back to back LEDs aimed in opposite directions and into the rim of the body. The reflective rim cap has a reflective lower surface. The light generated by the LED circles the rim of the body and is reflected by the rim cap into the walls of the body onto the bottom edge providing an attractive and recognizable light filling the body.

19 Claims, 2 Drawing Sheets

ILLUMINATED CUP HOLDER

The present application claims the priority of U.S. Provisional Patent Application Ser. No. 61/715,663 filed Oct. 18, 2012, which application is incorporated in its entirety herein by reference.

BACKGROUND OF THE INVENTION

The present invention relates to cup holders and in particular to cup holders including functional and esthetic illumination.

Cup holders are often used to prevent cups from overturning and spilling their contents. While such cup holders are common, there is also a need for a cup holder including illumination for easy locating in a dark room, for example, a home theater. While known cup holders provide some level of illumination, there remains a need for an illuminated cup holder providing a unique and recognizable appearance for easy locating.

BRIEF SUMMARY OF THE INVENTION

The present invention addresses the above and other needs by providing a illuminated cup holder which includes a power source in a base, light sources, a light conducting body, and a reflective rim cap. The power source may be batteries or an AC adapter, or both. The light conducting body includes a rim, walls, and a bottom edge. The bottom edge is preferably rippled to provide a light pattern. The light sources are preferably back to back LEDs aimed in opposite directions and into the rim of the body. An angled reflective rim cap has a reflective lower surface. The light generated by the LED circles the rim of the body and is reflected by the rim cap into the walls of the body onto the bottom edge providing an attractive and recognizable light filling the body.

In accordance with one aspect of the invention, there is provided an illuminated cup holder with back to back LEDs in a top rim of the cup and a reflective angled rim cap. The light from the LED circles a top rim of the cup and is reflected downward though cup walls providing an attractive illumination effect.

In accordance with one aspect of the invention, there is provided an illuminated cup holder having a rippled or scalloped bottom edge of the walls. Light transmitted downward through the walls is reflected off the ripples or scallops providing an attractive design.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1B:
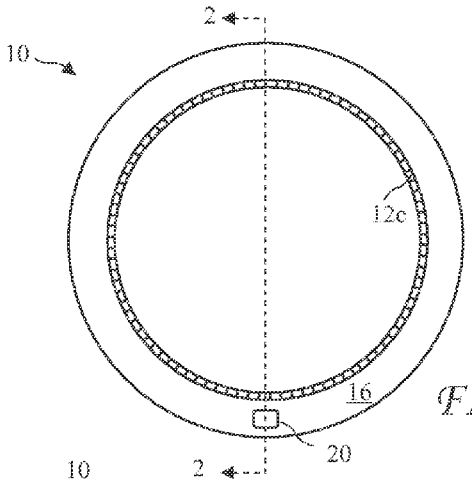
FIG. 1B is a top view of the illuminated cup holder according to the present invention.
Figure 1A:
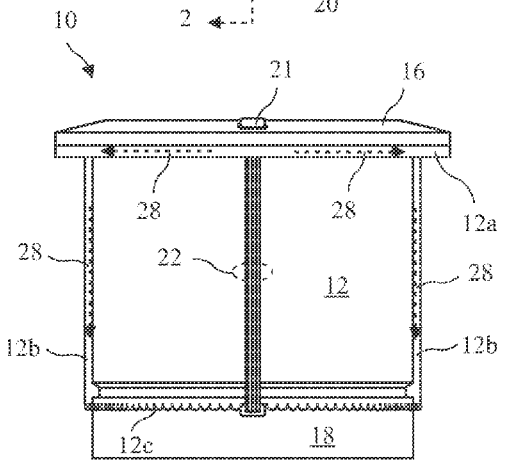
FIG. 1A is a side view of an illuminated cup holder according to the present invention.
Figure 2:
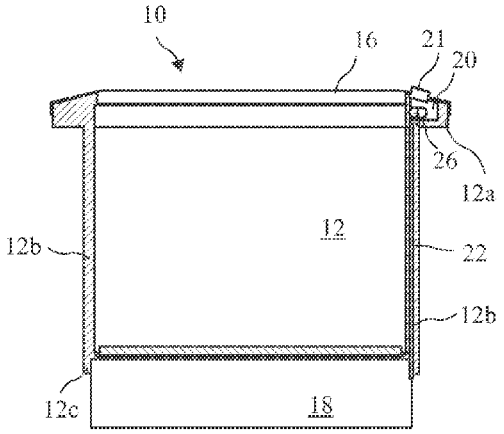
FIG. 2 is a cross-sectional side view of the illuminated cup holder according to the present invention taken along line 2-2 of FIG. 1B.
Figure 1C:
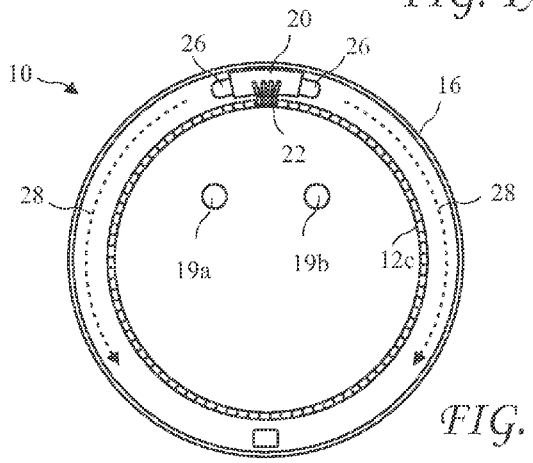
FIG. 1C is a bottom view of the illuminated cup holder according to the present invention.

FIG. 1A is a side view of an illuminated cup holder 10, FIG. 1B is a top view of the illuminated cup holder 10, FIG. 1C is a bottom view of the illuminated cup holder 10, and FIG. 2 is a cross-sectional side view of the illuminated cup holder taken along line 2-2 of FIG. 1B. The illuminated cup holder 10 includes a light conducting cylindrical body 12 having an upper rim 12*a*, walls 12*b*, and a bottom edge 12*c* including ripples or scallops 13. A reflective rim cap 16 resides over the upper rim 12*a*. The body 12 is made of a light conducting transparent material, and preferably a colorless light conducting transparent material.

LEDs 26 reside in the upper rim 12*a* and are pointed horizontally in opposite directions. The LEDs 26 are electrically connected to a switch 20 having a button 21 for turning the LEDs 26 on and off. The switch 20 preferably resides in the upper rim 12*a* and the button 21 extends through the reflective rim cap 16.

A power source 18 preferably resides under the body 12 and may include batteries or receptacles 19*a* and 19*b* or both. The receptacles 19*a* and 19*b* may be both for an AC adapter providing power to the illuminated cup holder 10 and an outlet for daisy chaining multiple illuminated cup holders 10. Wires 22 connect the power source 18 to the switch 20 to provide power to the LEDs 26.

When the LEDS 26 are receiving power, light 28 travels through the upper rim 12*a*, down the walls 12*b*, and onto the ripples or scallops 13 providing an attractive visual effect and helping a user to identify the illuminated cup holder 10 in a dark room.

Figure 3B:
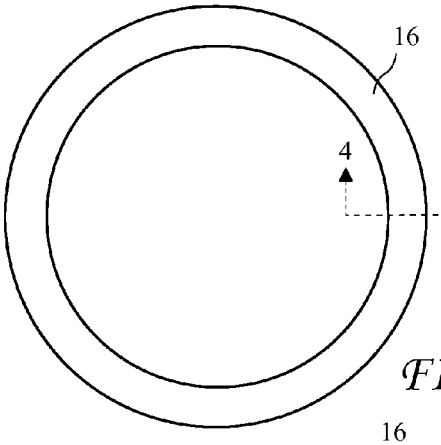
FIG. 3B is a side view of the reflective rim cap of the illuminated cup holder according to the present invention.
Figure 3A:
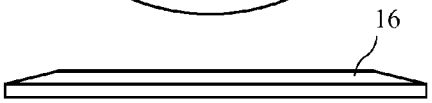
FIG. 3A is a side view of a reflective rim cap of the illuminated cup holder according to the present invention.
Figure 4:
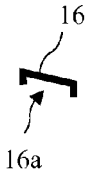
FIG. 4 is a cross-sectional side view of the reflective rim cap of the illuminated cup holder according to the present invention taken along line 4-4 of FIG. 3B.

FIG. 3A is a side view of a reflective rim cap 16 of the illuminated cup holder 10, FIG. 3B is a side view of the reflective rim cap 16, and FIG. 4 is a cross-sectional side view of the reflective rim cap taken along line 4-4 of FIG. 3B. The reflective rim cap 16 defines a beveled frustoconical surface has a reflective lower surface 16*a* reflecting light from the LEDs 26 back into the upper rim 12*a* to enhance the visual effects provided by the illuminated cup holder 10.

Figure 5:
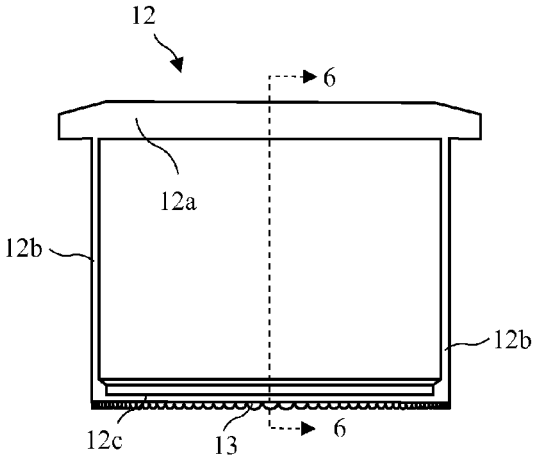
FIG. 5 is a side view of a body of the illuminated cup holder according to the present invention.
Figure 6:
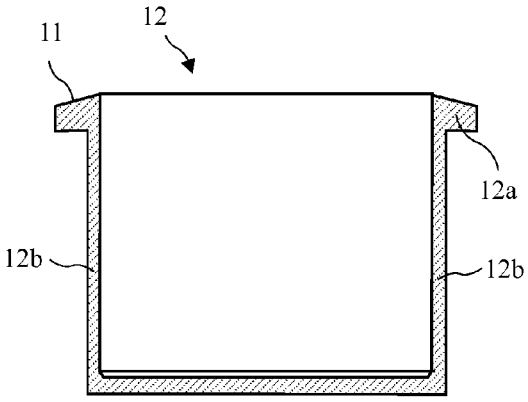
FIG. 6 is a cross-sectional side view of the body of the illuminated cup holder according to the present invention taken along line 6-6 of FIG. 5.

FIG. 5 is a side view of a body 12 of the illuminated cup holder 10 and FIG. 6 is a cross-sectional side view of the body 12 taken along line 6-6 of FIG. 5. The body 12 fills the area under the reflective rim cap 16 to provide for transmission of the light 28. The upper rim 12*a* the top rim extends out from the walls 12*b* providing a light conducting channel and preferably has an outward and downward beveled top surface 11, the rim cap 16 residing on the top surface.

While the invention herein disclosed has been described by means of specific embodiments and applications thereof, numerous modifications and variations could be made thereto by those skilled in the art without departing from the scope of the invention set forth in the claims.

I claim:

1. An illuminated cup holder comprising:
a power source;
a light conducting body comprising:
a top rim;
walls;
a bottom edge of the walls;
a circle of uniformly angularly spaced, downwardly extending ripples on the bottom edge of the walls; and
an interior cavity configured to receive a cup; and
light sources residing in the top rim.

2. The illuminated cup holder of claim 1, wherein the light sources are two back to back LEDs residing in the top rim of the body and facing in opposite directions.

3. The illuminated cup holder of claim 1, wherein the top rim extends out from the walls providing a light conducting channel.

4. The illuminated cup holder of claim 1, wherein the power source includes batteries residing below the body.

5. The illuminated cup holder of claim 1, wherein the body is a light conducting transparent material.

6. The illuminated cup holder of claim 1, wherein the circle of uniformly angularly spaced, downwardly extending ripples on the bottom edge of the walls comprises rounded downward convex shapes extending radially outward.

7. The illuminated cup holder of claim 1, wherein the circle of uniformly angularly spaced, downwardly extending ripples on the bottom edge of the walls resided entirely under the bottom edge of the walls.

8. The illuminated cup holder of claim 1, wherein the top rim defines a frustoconical shape.

9. The illuminated cup holder of claim 3, wherein the top rim includes an outward and downward beveled top surface.

10. The illuminated cup holder of claim 9, further including a rim cap covering the outward and downward beveled top surface of the top rim, the rim cap having a reflective bottom surface.

11. The illuminated cup holder of claim 10, wherein the body is a colorless light conducting transparent material.

12. The illuminated cup holder of claim 10, wherein the rim cap defines a frustoconical shape.

13. The illuminated cup holder of claim 12, wherein the rim cap resides above the walls.

14. The illuminated cup holder of claim 12, wherein the cup resides entirely below the rim cap.

15. The illuminated cup holder of claim 12, wherein the rim cap resides horizontally.

16. The illuminated cup holder of claim 6, wherein the rounded downward convex shapes extending radially outward are generally semicircular meeting at cusps.

17. The illuminated cup holder of claim 16, wherein the cusps define are angularly spaced apart radially extending cusps.

18. An illuminated cup holder comprising:
a power source;
a light conducting transparent cylindrical body comprising:
a top rim having an outward and downward beveled top surface;
walls, the top rim extending out from a top of the walls;
a scalloped bottom edge of the walls; and
an interior cavity configured to receive a cup;
two back to back LEDs residing in the top rim of the body and facing in opposite directions; and
a rim cap covering the outward and downward beveled top surface of the top rim, the rim cap having a reflective bottom surface.

19. An illuminated cup holder comprising:
a power source;
a light conducting transparent cylindrical body comprising:
a top rim having a frustoconical shaped, outward and downward beveled top surface;
walls, the top rim extending out over a top of the walls;
a rippled bottom edge of the walls, the ripples having angularly spaced apart, radially extending, downward convex rounded bottom surfaces meeting at angularly spaced apart radially extending upward pointing cusps; and
an interior cavity configured to receive a cup;
two back to back LEDs residing in the top rim of the body and facing in opposite directions; and
a frustoconical shaped, outward and downward beveled rim cap covering the outward and downward beveled top surface of the top rim, the rim cap having a reflective bottom surface.

* * * * *